US008300876B2

(12) United States Patent
Xu

(10) Patent No.: US 8,300,876 B2
(45) Date of Patent: Oct. 30, 2012

(54) MICRO-SPEAKER AND METHOD FOR MANUFACTURING SAME

(75) Inventor: Tong-Ming Xu, Shenzhen (CN)

(73) Assignees: AAC Acoustic Technologies (Shenzhen) Co., Ltd., Shenzhen (CN); AAC Technologies Pte. Ltd, Singapore (SG)

( * ) Notice: Subject to any disclaimer, the term of this patent is extended or adjusted under 35 U.S.C. 154(b) by 186 days.

(21) Appl. No.: 12/978,594

(22) Filed: Dec. 26, 2010

(65) Prior Publication Data

US 2011/0243371 A1 Oct. 6, 2011

(30) Foreign Application Priority Data

Apr. 6, 2010 (CN) ..... 2010 1 0144926

(51) Int. Cl.
*H04R 1/00* (2006.01)
*H04R 25/00* (2006.01)

(52) U.S. Cl. ..... 381/433; 381/431; 381/150; 381/412

(58) Field of Classification Search ..... 381/150, 381/345, 355, 361, 409, 410, 431, 433
See application file for complete search history.

(56) References Cited

U.S. PATENT DOCUMENTS

| | | | | |
|---|---|---|---|---|
| 3,428,934 | A * | 2/1969 | Lamonte, Jr. et al. | 439/876 |
| 3,980,367 | A * | 9/1976 | Laserson et al. | 439/65 |
| 4,570,338 | A * | 2/1986 | Ignatowicz | 29/845 |
| 5,091,958 | A * | 2/1992 | Sakamoto et al. | 381/150 |
| 2008/0192976 | A1 * | 8/2008 | Kim | 381/412 |

* cited by examiner

*Primary Examiner* — Curtis Kuntz
*Assistant Examiner* — Sunita Joshi
(74) *Attorney, Agent, or Firm* — IPro, Inc.; Na Xu

(57) ABSTRACT

A method of soldering terminals of a micro-speaker on a circuit board comprises the following steps. Firstly, providing a circuit board having a pair of through holes passing therethrough, and two soldering sections defined surrounding the pair of through holes. Secondly, the soldering sections are plated with soldering tin. Thirdly, providing a pair of columned terminals, the terminal includes an upper portion, a low portion and a body connecting between the upper portion and the low portion. Fourthly, the low portion of the terminal is inserted into the corresponding through hole and the body is resisted on the soldering section. Fifthly, the soldering tin is heated to solder the body on the soldering tin. Finally, the upper portion of the terminal is soldered onto the corresponding end of the voice coil. As a result, soldering defective can be reduced.

12 Claims, 4 Drawing Sheets

MICRO-SPEAKER AND METHOD FOR MANUFACTURING SAME

BACKGROUND OF THE INVENTION

1. Field of the Invention

The present disclosure relates to the art of speakers and, particularly to A micro-speaker and a method of manufacturing the micro-speaker for converting electrical signals including audio information to audible sounds.

2. Description of Related Art

Recently, as the micro-speakers are becoming smaller in size and diversified in function, circuit boards are widely used in the micro-speakers which are required to have high circuit density and reliability.

Usually, in order to reduce the size and ensure the sound output quality of the micro-speaker, surface mounted technology (SMT) is widely used in packaging two ends of a voice coil of the mircro-speaker onto the corresponding conductive pads of the circuit board. When assembly of the voice coil and the circuit board by SMT, a solder paste is firstly applied to be heated and then applied to the conductive pads of the circuit board by screen printing or stencil printing. Then the two ends of the voice coil are placed on the top of the solder paste. Finally, the solder paste is heated to reflow the ends of the voice coil and the conductive pads of the circuit board, thereby the electrical connection between the voice coil and the circuit board is established.

However, during the solder reflow process, additional warping of the circuit board may occur because lack of symmetry heating, thereby the ends of the voice coil can not accurately solder onto the conductive pads of the circuit board, resulting in defective electrical connection between the conductive pads of the circuit board and the corresponding ends of the voice coil. Thus, the sound output quality of the micro-speaker may be adversely affected.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
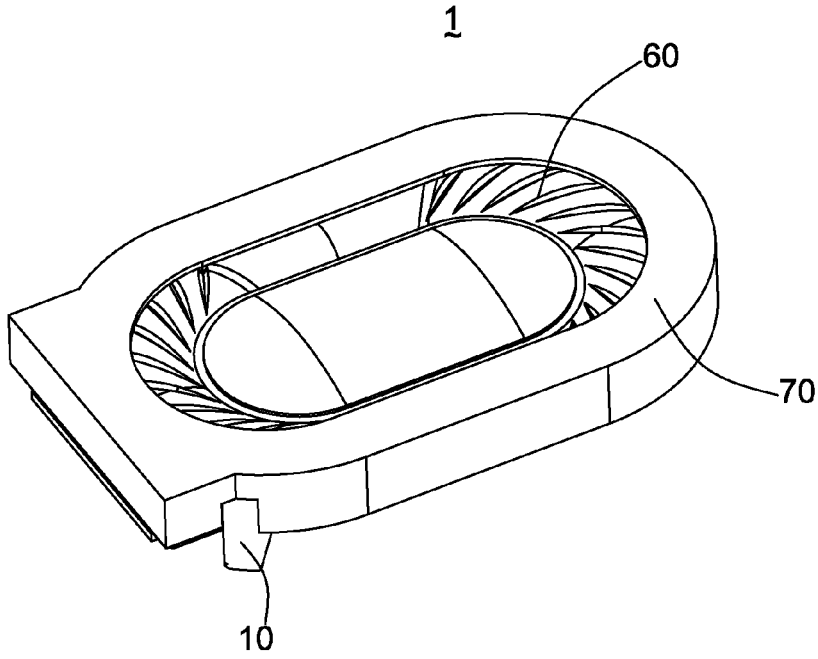
FIG. 1 is an assembly view of a micro-speaker according to an exemplary embodiment.
Figure 2:
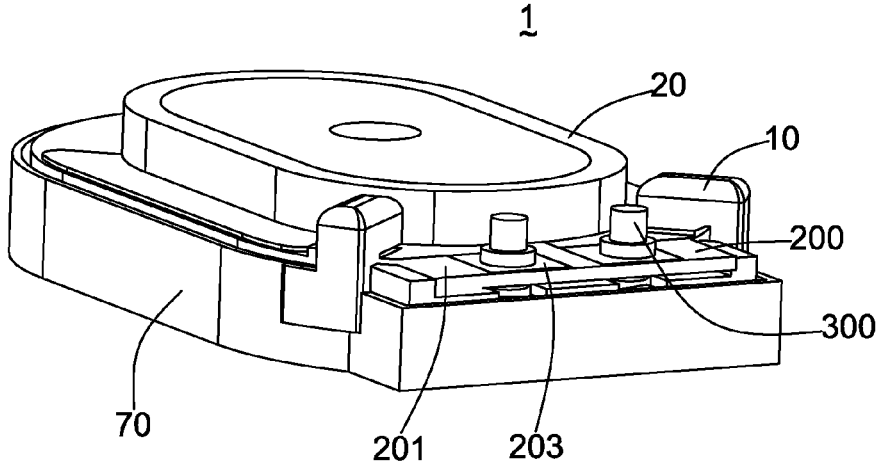
FIG. 2 is similar to FIG. 1, but showing the micro-speaker inverted.
Figure 3:
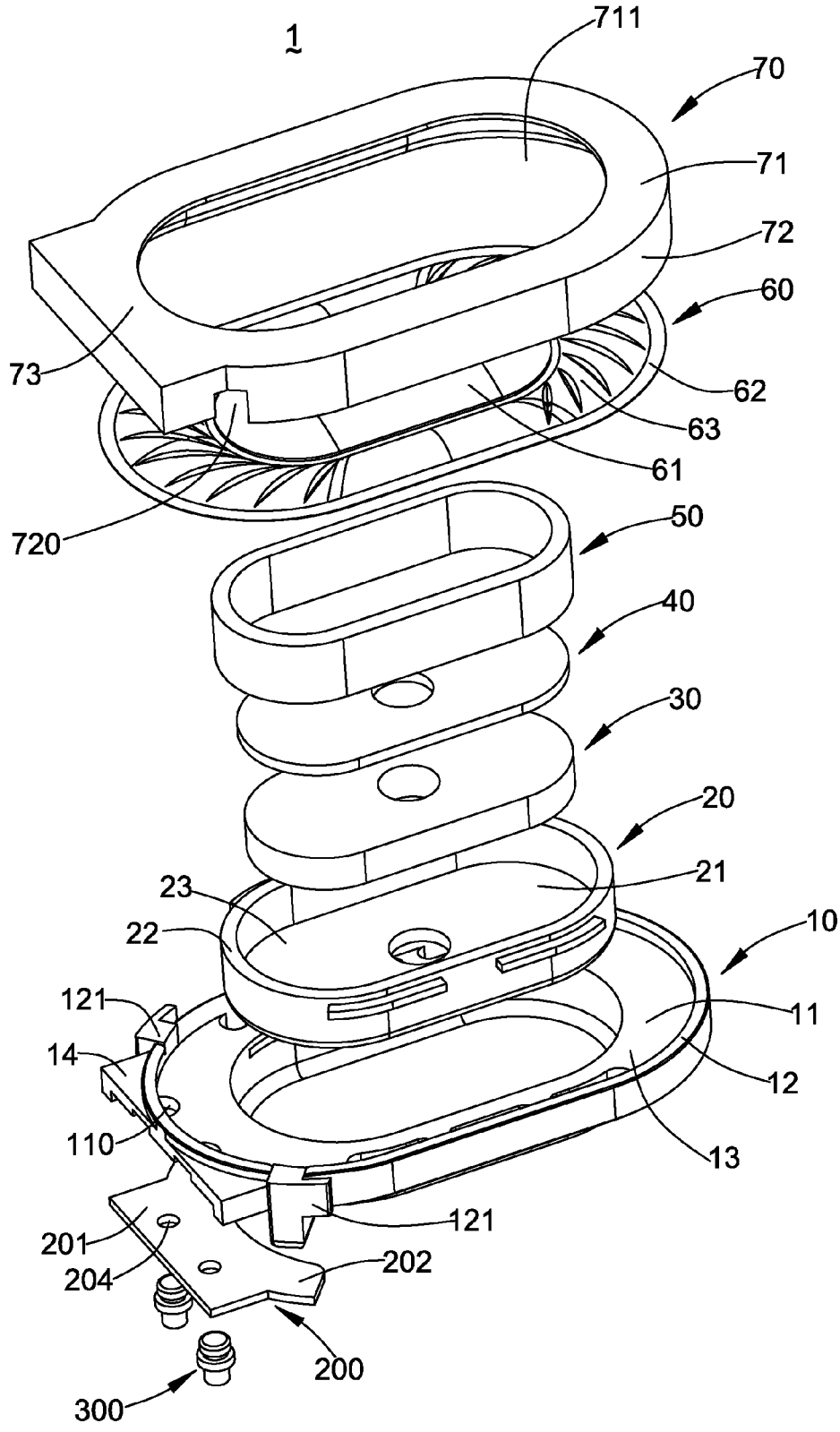
FIG. 3 is an exploded, isometric view of the micro-speaker of FIG. 1.
Figure 4:
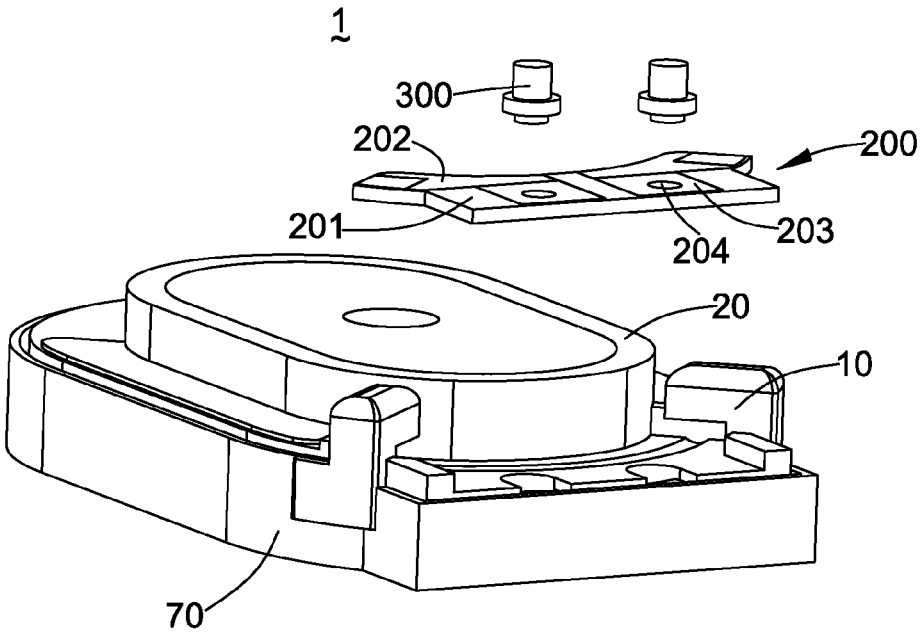
FIG. 4 is similar to FIG. 2, but showing terminals not positioned on a circuit board of the micro-speaker.
Figure 5:
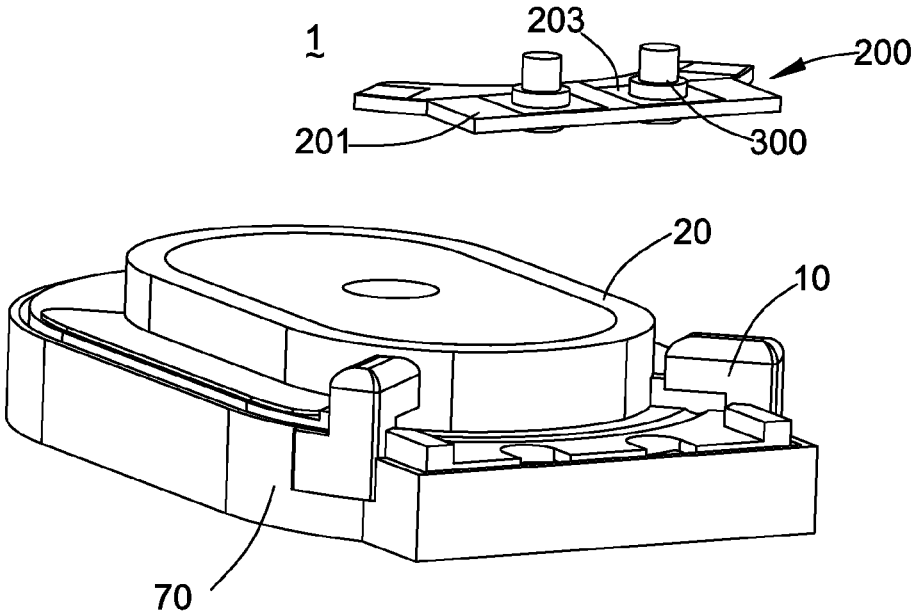
FIG. 5 is similar to FIG. 4, but showing terminals positioned on the circuit board of the micro-speaker.

Referring to FIGS. 1-5, a micro-speaker 1, according to an exemplary embodiment, includes a frame 10, a yoke 20 engaged with the frame 10, a magnet 30 received in the yoke 20, a pole plate 40 attached on the magnet 30, a voice coil 50 surrounding the magnet 30 and the pole plate 40, a diaphragm 60 attached to the frame 10, a case 70 covering the diaphragm 60, a circuit board 200 engaged with the frame 10 and electrically connected to the voice coil 50 via a pair of terminals 300. The frame 10 cooperatively with the case 70 define a chamber (not labeled) therebetween for receiving the yoke 20, the magnet 30, the pole plate 40, the voice coil 50 and the diaphragm 60 therein.

The frame 10 includes a base plate 11, an upper plate 12 extending upwardly and perpendicularly from an outer periphery of the base plate 11, a flange 14 extending outwardly from an outer side of the side plate 12, and a low plate (not labeled) extending downwardly and perpendicularly from a bottom portion of the base plate 11. The base and side plates cooperatively define a receiving space 13 therebetween. The base plate 11 is elliptical, and the yoke 20 is located at a center of the base plate 11. The upper side plate 12 defines a pair of protrusions 121 extending toward to the center of the receiving space 13 and formed adjacent to the flange 14. A pair of through holes 110 is formed at an end thereof adjacent to the flange 14 and passes through the top and bottom surfaces thereof. Therefore, two opposite ends of the voice coil 50 can extend through the pair of through holes 121 to electrically connect to the pair of terminals 300 soldered onto the circuit board 200. The outer diameter of the upper side plate 12 is greater than the outer diameter of the low side plate.

The yoke 20 is substantially oblong bowl-shaped, and includes a base wall 21 and a first sidewall 22 extending upwardly and perpendicularly from an outer periphery of the base wall 21. The base wall 21 and the first sidewall 22 cooperatively define a receiving chamber 23 therebetween. A top end of the first sidewall 22, namely at an open end of the yoke 20, is located at an inner periphery of the base plate 11 of the frame 10.

The magnet 30 is elliptically cylindrical configuration, and attached to a top surface of the base wall 21 of the yoke 20. The pole plate 40 is elliptical and laminar, and attached to a top surface of the magnet 30. The magnet 30 and the pole plate 40 are received in the receiving chamber 23 of the yoke 20, and are coaxial with the yoke 20. An outer diameter of the magnet 30 and an outer diameter of the pole plate 40 are smaller than an inner diameter of the yoke 20. Thereby, outer peripheral side surfaces of the magnet 30 and the pole plate 40, and the first sidewall 22 of the yoke 20, cooperatively define an annular gap (not shown) therebetween, for accommodating a bottom end of the voice coil 50 therein. The voice coil 50 surrounds the magnet 30 and the pole plate 40 and is movable upwardly and downwardly in the annular gap.

The diaphragm 60 is elliptical and includes a central area 61 in a center thereof, a joint area 62 at an outer periphery thereof, and a connecting area 63 between the central area 61 and the joint area 62. The central area 61, the joint area 62, and the connecting area 63 are coaxial. The connecting area 63 is disposed at an outer periphery of the central area 61, and is curved upwardly to form an annular bulge. The joint area 62 is annular and disposed at an outer periphery of the connecting area 63.

The case 70 is oblong configuration and covers the diaphragm 60. The case 70 includes a first top wall 71, a second sidewall 72 extending downwardly and perpendicularly from an outer periphery of the first top wall 71, and a first connecting portion 73 extending outward from an edge of the first top wall 71. The first top wall 71 is annular and planar, and defines a sound outlet 711 on a central area thereof. Sound generated by the micro-speaker 100 is transmitted to the outside of the micro-speaker 100 through the sound outlet 711. The second sidewall 72 defines a pair of recesses 720 formed adjacent to the first connecting portion 73 to pass the protrusions 121 therethrough. The first connecting portion 73 covers the flange 14 of the frame 10.

The circuit board 200 is substantially U-shaped configuration and attached to the bottom of the base plate 11. The circuit board 200 includes a body portion 201, and an arc portion 202 extending outward from an outer periphery of the body portion 201. The body portion 201 is rectangular, and defines a pair of soldering sections 203 formed on the bottom thereof and a pair of through openings 204 formed on the center of the corresponding soldering sections 203 and corresponding to the through holes 110 of the frame 10. The arc portion 202 covers on the bottom of the flange 14 of the frame 10. The terminal 300 is columned configuration and includes an upper portion 301, a low portion 302, a body 303 connected between the upper portion 301 and the low portion 302, and a throng portion 304 connected between the body 303 and the low portion 302. The outer diameter of the throng portion 304 is substantially equal to the internal diameter of the through opening 204, but smaller than the outer diameter of the body 303. Further, the outer diameter of the low portion 302 is greater than the internal diameter of the through opening 204. Thus, while the terminal 300 is assembled with the circuit board 200, the body 303 prevents the terminal 300 moving downwardly and the low portion 302 prevents the terminal 300 moving upwardly. Therefore, the terminal 300 is firmly fixed to the circuit board 200 with the throng portion 304 received in the through opening 204. During assembly the circuit board 200 and the voice coil 50, the soldering section 203 is firstly plated with soldering tin. In the present embodiment, the thickness of the soldering tin on the soldering section 203 is 20 um-30 um. The low portion 302 of the terminal 300 is secondly inserted into the corresponding through opening 204, thereby the body 303 of the terminal 300 is resisting on the top of the soldering section 203. The soldering tin is heated to liquid at high temperature so as to solder the body 303 of the terminal 300 onto the soldering tin of the soldering section 203. Finally, the circuit board 200 with the terminals 300 is positioned on the bottom of the base plate 11 of the frame 10 via the protrusions 121 pressing onto the bottom of the arc portion 202, and then the two opposite ends of the voice coil 50 respectively passes through the through holes 110 and inserts into the through openings 204 to solder with the low portion 302 of the terminal 300, thereby the reliably electrical connection between the circuit board 200 and the voice coil 50 is obtained and the sound output quality of the micro-speaker is ensured. In fact, before being heated, the low portion 302 has an outer diameter equal to the outer diameter of the throng portion 304 for easily passing through the opening 204, and when the body 303 resists on the top of the soldering section 203, the low portion 302 is heated and spreads along a transverse direction to be provided with an enlarged diameter greater than the outer diameter of the throng portion 304.

Figure 6:
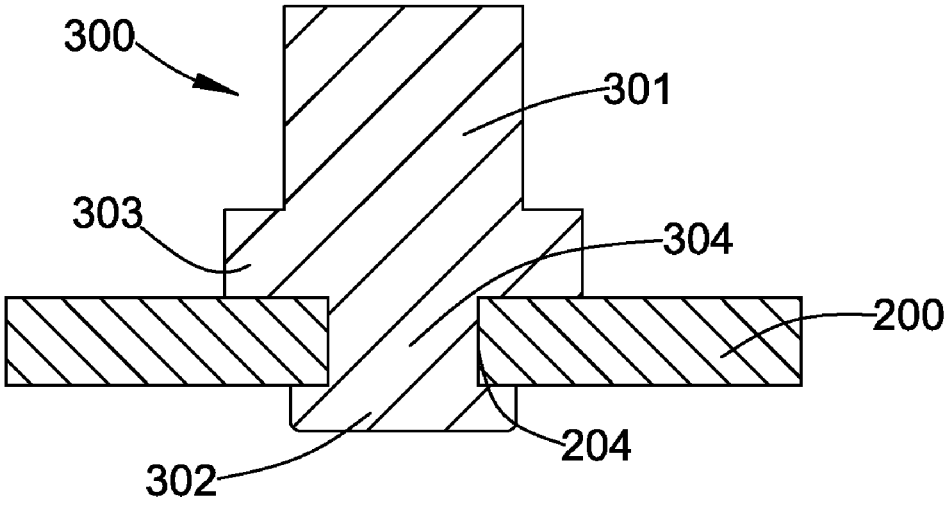
FIG. 6 is a cross-sectional view illustrating the terminals assembled with the circuit board.

Referring to FIG. 6, a method assembly the circuit board 200 to the voice coil 50 is shown. The method includes the following steps:

S1: a circuit board is provided for having an upper surface and a bottom surface opposite to the upper surface, a pair of through openings passing through the upper and bottom surfaces, and two soldering sections defined surrounding the pair of the through openings;

S2: the soldering sections are plated soldering tin, the thickness of the soldering tin on the soldering sections is 20 um-30 um;

S3: a pair of columned terminals is provided. The terminals each includes an upper portion, a low portion, a body connecting between the upper and low portions, a throng portion connected between the body and the low portion, the outer diameter of the throng portion is smaller than the outer diameter of the body but substantially equal to the internal diameter of the through opening;

S4: the low portion of the terminal is inserted into the corresponding through opening and the body of the terminal is resisted on the top of the soldering section;

S5: the soldering tin and the low portion are heated so as to the body of the terminal is soldered on the soldering tin of the soldering section, and the low portion spreads to have a diameter greater than the diameter of the throng portion;

S6: the low portion of the terminal is soldered onto the corresponding end of the voice coil, thereby the micro-speaker is completed.

In the present disclosure of the micro-speaker, because the two opposite ends of the voice coil are respectively soldered onto the upper portion of the terminal, and the terminal is inserted into the through opening and soldered onto the soldering section of the circuit board, a reliably electrical connection between the voice coil and the circuit board is obtained, thereby reliable current applied to the voice coil is obtained. Thus, the sound output quality of the micro-speaker is ensured.

It is to be understood, however, that even though numerous characteristics and advantages of the present embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-speaker comprising:

a frame defining a pair of holes passing through a top and bottom surfaces thereof;

a case supported on the frame and cooperatively with the frame defining a chamber therebetween;

a diaphragm received in the chamber and attached to the frame;

a yoke received in the chamber;

a magnet received in the chamber and attached on the top of the yoke;

a pole plate received in the chamber and attached to the top of the magnet;

a voice coil attached to the bottom of the diaphragm and surrounding the magnet and the pole plate;

a circuit board mounted on the bottom of the frame, the circuit board defining a pair of soldering sections formed on the bottom thereof, and a pair of through openings passing through the soldering sections;

soldering tin soldered on the soldering sections; and wherein the circuit board is electrically connected with the corresponding ends of the voice coil via a pair of columned terminals to apply electric current to the voice coil, the terminal comprises an upper portion, a lower portion, a body connecting between the upper and lower portions, and a throng portion connected between the body and the low portion, the outer diameter of the body being greater than the outer diameter of the throng portion, and the outer diameter of the low portion being greater than the outer diameter of the throng portion, the low portion being soldered with the ends of the voice coil via heating soldering tin.

2. The micro-speaker as claimed in claim 1, wherein the circuit board is substantially U-shaped configuration and includes a body portion, and an arc portion extending outwardly from an outer periphery of the body portion, the body portion is rectangular, and the pair of soldering sections is defined on the body portion.

3. The micro-speaker as claimed in claim 1, wherein the thickness of the soldering tin is 20 um-30 um.

4. The micro-speaker as claimed in claim 1, wherein the frame is a approximately oblong bowl-shaped, and includes a base plate, an upper side plate extending upwardly and perpendicularly from an outer periphery of the base plate, a rectangular flange extending outwardly from an outer side of the side plate, and a low side plate extending downwardly and perpendicularly from a bottom portion of the base plate.

5. The speaker as claimed in claim 4, wherein the base and side plates cooperatively define a receiving space therebetween, the base plate is elliptical for supporting the yoke thereon.

6. The speaker as claimed in claim 5, wherein the upper side plate defines a pair of protrusions extending toward the center of the receiving space and formed adjacent to the flange, the pair of through holes is formed at an end thereof adjacent to the flange.

7. The speaker as claimed in claim 6, wherein the case is oblong configuration and covers the diaphragm, the case includes a first top wall, a sidewall extending downwardly and perpendicularly from an outer periphery of the first top wall, and a first connecting portion extending outwardly form an edge of the first top wall, the first top wall is annular and planar, and defines a sound outlet on a central area thereof.

8. The speaker as claimed in claim 7, wherein the magnet and the pole plate are elliptically cylindrical configuration.

9. The speaker as claimed in claim 8, wherein the diaphragm is elliptical, and has a thin cross-section, with the thickness of the diaphragm being substantially constant throughout the cross-section.

10. The Speaker as claimed in claim 9, wherein the diaphragm includes a central area in a center thereof, a joint area at an outer periphery thereof, and a connecting area between the central area and the joint area, the central area, the joint area and the connecting area are coaxial.

11. A method of assembly a circuit board of a micro-speaker, the micro-speaker comprising a voice coil with two opposite ends thereof, the method comprising the following steps:

providing a circuit board having an upper surface and a bottom surface opposite to the upper surface, a pair of through openings passing through the upper and bottom surfaces, and two soldering sections defined surrounding the pair of through openings;

plating soldering tin on the soldering sections and solidifying the soldering tin;

providing a pair of columned terminals, the terminal including an upper portion, a low portion, a body connecting between the upper and low portions, and a throng portion connected between the body and the low portion;

inserting the low portion of the terminal into the through opening and the body of the terminal resisting on the top of the soldering section;

heating the solid soldering tin to liquid at a high temperature so as to solder the body of the terminal and the soldering tin on the soldering section;

soldering the low portion of the terminal for spreading the outer diameter of the low portion and soldering to the corresponding end of the voice coil.

12. The method as claimed in claim 11, wherein the thickness of the soldering tin is 20 um-30 um.

* * * * *